US005469178A

United States Patent [19]

Nguyen et al.

[11] Patent Number: 5,469,178

[45] Date of Patent: Nov. 21, 1995

[54] LOW PROFILE ANTENNA SYSTEM FOR A CARDLIKE COMMUNICATION RECEIVER

[75] Inventors: Tuan K. Nguyen, Boca Raton; Pha Nguyen, Lake Worth; Donna A. Clark, West Palm Beach; Robert A. Marinelli, Boynton Beach, all of Fla.

[73] Assignee: Motorola, Inc., Schaumburg, Ill.

[21] Appl. No.: 252,137

[22] Filed: May 31, 1994

Related U.S. Application Data

[63] Continuation of Ser. No. 954,230, Sep. 30, 1992, abandoned.

[51] Int. Cl.[6] ..... H01Q 1/24

[52] U.S. Cl. ..... 343/702; 343/741; 343/866; 455/274

[58] Field of Search ..... 343/702, 741, 343/745, 744; 455/90, 347, 269, 274, 351; H01Q 1/24

[56] References Cited

U.S. PATENT DOCUMENTS

| | | | |
|---|---|---|---|
| 3,605,104 | 9/1979 | Weston et al. | 343/741 |
| 4,862,181 | 8/1989 | Ponce de Leon et al. | 343/702 |
| 4,924,237 | 5/1990 | Honda et al. | 343/702 |
| 4,935,745 | 6/1990 | Mori et al. | 343/702 |
| 4,939,792 | 7/1990 | Urbish et al. | 455/347 |
| 4,940,992 | 7/1990 | Nguyen et al. | 343/803 |
| 4,955,084 | 9/1990 | Umetsu et al. | 343/702 |
| 4,995,099 | 2/1991 | Davis | 455/343 |
| 5,023,621 | 6/1991 | Ushiyama et al. | 343/702 |
| 5,048,118 | 9/1991 | Brooks et al. | 343/702 |
| 5,054,120 | 10/1991 | Ushiyama et al. | 455/351 |
| 5,079,559 | 1/1992 | Umetsu et al. | 343/702 |
| 5,113,196 | 5/1992 | Ponce de Leon et al. | 343/744 |
| 5,182,568 | 1/1993 | Stamps, Jr. et al. | 343/702 |

OTHER PUBLICATIONS

Plastics Engineering Handbook of the Society of the Plastics Industry, Inc. Fourth Edition, edited by Joel Frados Copyright 1976 (p. 23) Published by Van Nostrand Reinhold Co. New York.

*Primary Examiner*—Donald Hajec
*Assistant Examiner*—Tan Ho
*Attorney, Agent, or Firm*—Philip P. Macnak; John H. Moore; Daniel K. Nichols

[57] ABSTRACT

A low profile antenna system comprises a frame having front and side surfaces for enclosing a printed circuit board supporting a receiver, the front surface of the frame including a first conductive plate, an isolated portion thereof, which couples to the printed circuit board and forms a first portion of a loop antenna. A conductor is coupled to the printed circuit board and forms a second portion of the loop antenna. A second conductive plate is coupled to the frame and forms a rear surface of the frame to completely enclose the printed circuit board. The second conductive plate is capacitively coupled to the conductor thereby enhancing the sensitivity of the loop antenna.

15 Claims, 5 Drawing Sheets

LOW PROFILE ANTENNA SYSTEM FOR A CARDLIKE COMMUNICATION RECEIVER

This is a continuation of application Ser. No. 07/954,230, filed Sep. 30, 1992 now abandoned.

BACKGROUND OF THE INVENTION

1. Field of the Invention

The present invention relates generally to the field of antennas, and more particularly to a low profile antenna system for a card-like communication receiver.

2. Description of the Prior Art

Card-like communication receivers, such as credit card paging receivers have become popular in many countries throughout the world. However, because of their limited size, especially in their thickness, it has often been a problem to provide an effective antenna. One solution to the antenna problem has been to use the plates forming the front and rear covers of the card-like receiver as the conductive elements of a loop antenna. While this solution produced a functional loop antenna, additional complication in the design was encountered due to problems in coupling the plates to the printed circuit board supporting the receiver circuitry while continuing to allow access to the inside of the housing.

Because the aperture of the loop antenna formed by the front and rear cover plates is relatively small, other solutions were proposed to improve the performance of the loop antenna. One such solution was to provide a slot antenna which was integrated with and formed a part of the housing of the card-like receiver.

Because most prior art antennas for card-like communication receivers utilized a loop antenna, receiver sensitivity was generally good when the receiver was positioned on the body due to well known body enhancement effects, however, receiver sensitivity was generally significantly degraded when the card-like receiver was removed from the body, such as when set on a desk. One solution for providing improved receiver sensitivity off the body was to provide a center-fed antenna loop into which was interposed a dielectric. Such an antenna functioned as a loop antenna when the card-like receiver was carried on the body, and acted as a dipole antenna when the card-like receiver was removed from the body. While providing the performance improvements, such an antenna was generally more suitable for use at lower receiver operating frequencies.

As a result, what is needed is a receiving antenna for a card-like communication receiver operating at higher receiver operating frequencies, such as at 930 MHz, and which provides good sensitivity when worn on the body, and also good sensitivity when removed from the body.

SUMMARY OF THE INVENTION

In accordance with one aspect of the present invention a low profile antenna system comprises a frame having a front surface and four contiguous side surfaces for supporting and partially enclosing a printed circuit board having first surface which supports components of a receiver and a second surface. The front surface of the frame includes a first conductive plate and an isolated portion which are positioned apart from and substantially parallel to the first surface of the printed circuit board. The isolated portion couples to the first surface of the printed circuit board and forms a first portion of a loop antenna. A conductor is positioned apart from and substantially parallel to the second surface of the printed circuit board, and couples thereto for forming a second portion of the loop antenna. A second conductive plate is positioned adjacent and substantially parallel to the conductor and mechanically couples to the frame for forming a rear surface thereof. The second conductive plate is capacitively coupled to the conductor and provides a means for enhancing the sensitivity of the loop antenna.

In another aspect of the present invention a communication receiver comprises a frame which has front and side surfaces for enclosing a printed circuit board supporting a receiver. A first conductive plate and an isolated portion thereof couples to the printed circuit board and forms a first portion of a loop antenna. A conductor is coupled to the printed circuit board and forms a second portion of the loop antenna. A conductive plate is coupled to the frame and forms a rear surface for the frame. The conductive plate is electrically coupled to the loop antenna and provides a means for enhancing the sensitivity of the loop antenna. The receiver is coupled to the loop antenna and the conductive plate for receiving a transmitted selective call message including address and message information. A decoder, coupled to the receiver, enables reception of the transmitted message information in response to a reception of the transmitted address. The received message information is displayed on a display.

DESCRIPTION OF THE PREFERRED EMBODIMENTS

Figure 1:
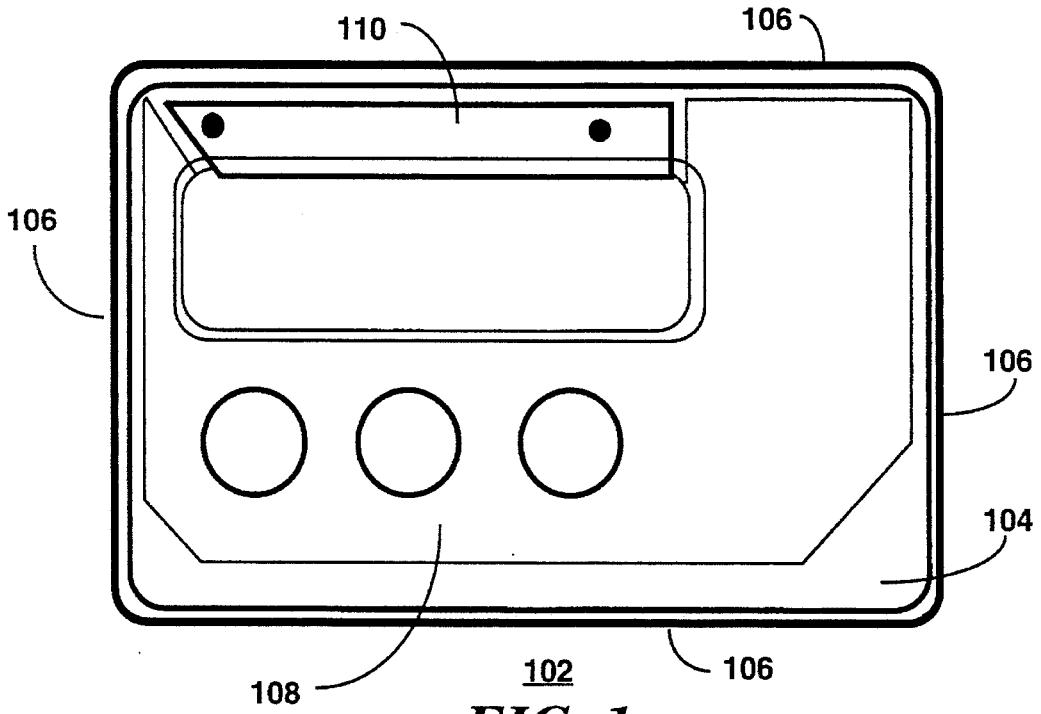
FIG. 1 is a plan view of the housing of a card-like communication receiver in accordance with a first embodiment of the present invention.

FIG. 1 is an inside plan view of the frame 102 of a card-like communication receiver in accordance with a first embodiment of the present invention. The frame comprises a front wall, or surface, 104 and four side walls, or surfaces, 106. The frame 102 is preferably manufactured using injection molding techniques using a thermoplastic material such as Ryton™ or a 30% glass filled polycarbonate material. Molded within the front surface using an insert molding technique is a conductive plate 108, a portion 110 of which after forming is isolated using a punch and die arrangement to shear the material, thereby separating the plate portion 110 from the plate 108. The isolated plate 110 forms a first portion of a loop antenna, as will be described in detail below. The front plate 108, 110 is manufactured using a sheet metal, such as 303 stainless steel, or other suitable material. The sheet metal is plated to improve electrical conductivity using a silver plating, although other suitable platings may be utilized as well. The insert molded front plate allows a thinner front wall cross section, and enhances the rigidity of the frame.

It will be appreciated that alternate methods for manufacturing the frame 102 may be utilized as well, such as by conventional injection molding techniques, after which the conductive plate 108 and the isolated portion 110 are affixed to the inside of the front surface 108 using such bonding techniques as an adhesive or double sided tape.

Figure 2:
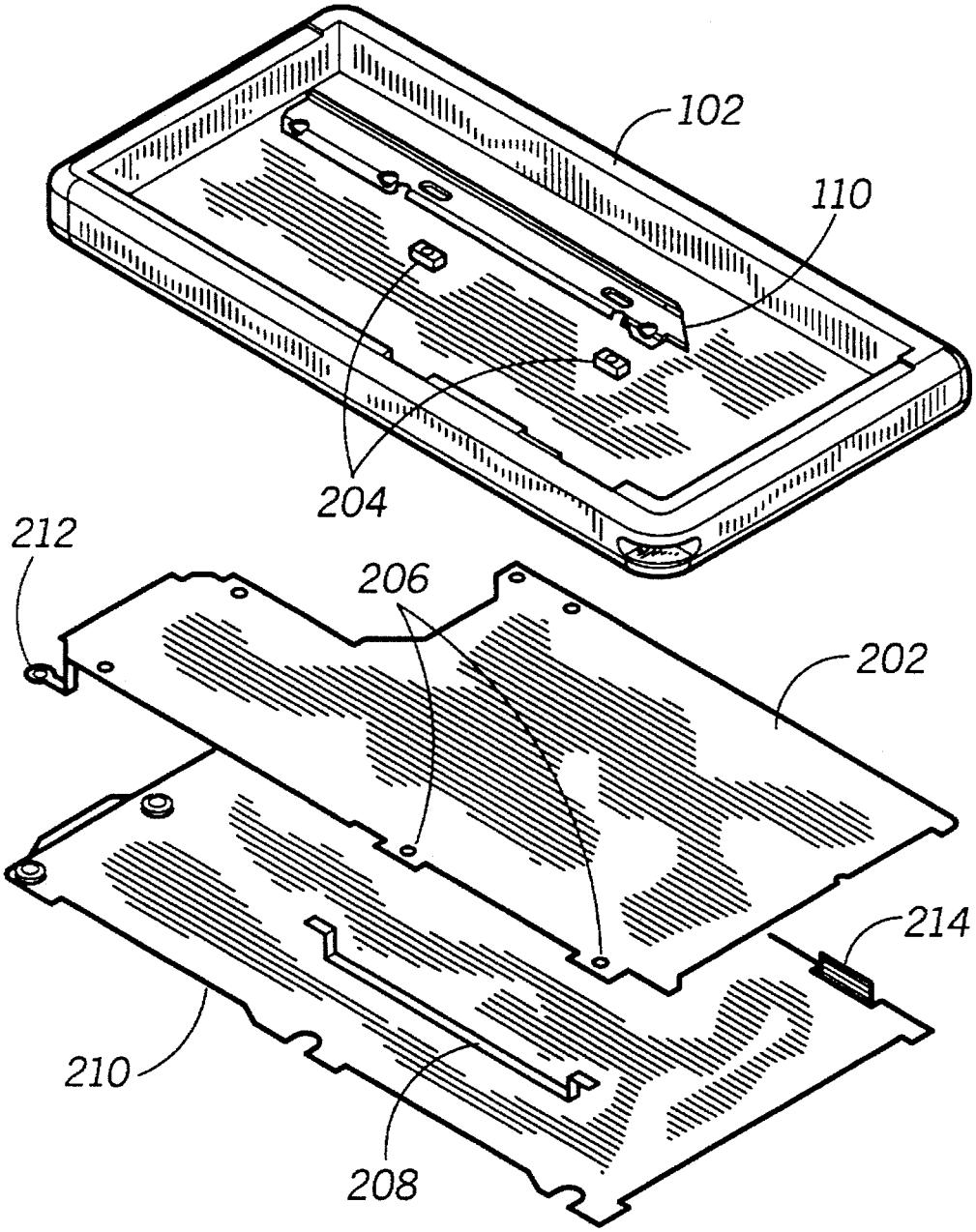
FIG. 2 is an exploded isometric view of the card-like communication receiver in accordance with the first embodiment of the present invention.

FIG. 2 is an exploded isometric view of the card-like communication receiver in accordance with the first embodiment of the present invention. The frame 102 encloses a printed circuit board 202, manufactured using a glass epoxy or other suitable board material, and supports the components forming the receiver and other associated receiver functions. Attached to the isolated plate 110 are a pair of fasteners, such as threaded inserts 204 which are attached to the isolated plate 110 using such fastening techniques as swagging or soldering. A pair of screws (not shown) secure the printed circuit board 202 to the front plate 108, 110 and frame 102 when threaded into the threaded inserts 204. The threaded inserts 204 also provide electrical coupling of the isolated plate 110 to circuitry on the printed circuit board 202. A conductor 208, formed preferably from sheet metal, such as hard copper or beryllium copper which is suitably plated to enable soldering, such as with a tin plating, is attached to the printed circuit board 202 such as by reflow soldering, and forms a second portion of the loop antenna for the receiver. A second, or back, plate 210 is also formed from sheet metal, such as stainless steel, or other suitable material which is plated to improve electrical conductivity using a silver plating, although other suitable platings may be utilized as well. The back plate 210 is secured to the frame 102 by fingers 214 contiguously formed from the back plate 210 which interlock into the frame 102 and is also secured with screws (not shown). The back plate 210 is electrically coupled to a ground formed on the printed circuit board 202 through a sheet metal conductor 212 which is attached to the printed circuit board 202, such as by reflow soldering, and is secured between the frame 102 and the back plate 210 with the use of a screw (not shown).

Figure 3:
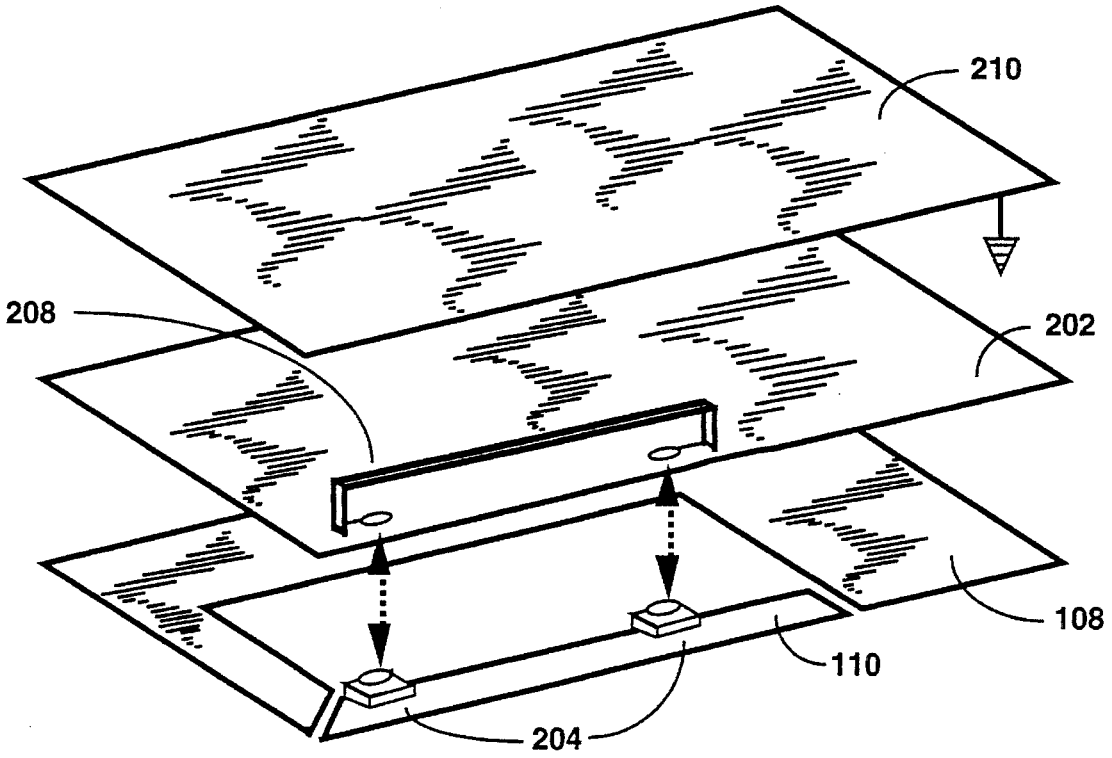
FIG. 3 is an electro/mechanical view of the antenna of the card-like communication receiver in accordance with the first embodiment of the present invention.

FIG. 3 is an electro/mechanical view of the antenna of the card-like communication receiver in accordance with the first embodiment of the present invention. As shown, the isolated portion 110 of the front plate 108, when attached to the printed circuit board 202 forms a first portion of a loop antenna. The balance of the loop antenna is formed by the conductor 208 which is soldered to the printed circuit board 202. The back plate 210 when attached to the frame 102 is in close proximity to the conductor 208 forming the upper part of the loop antenna, and operationally electrically couples to the loop antenna, enhancing the operation of the loop antenna when the card-like communication receiver is removed from the body.

Figure 4:
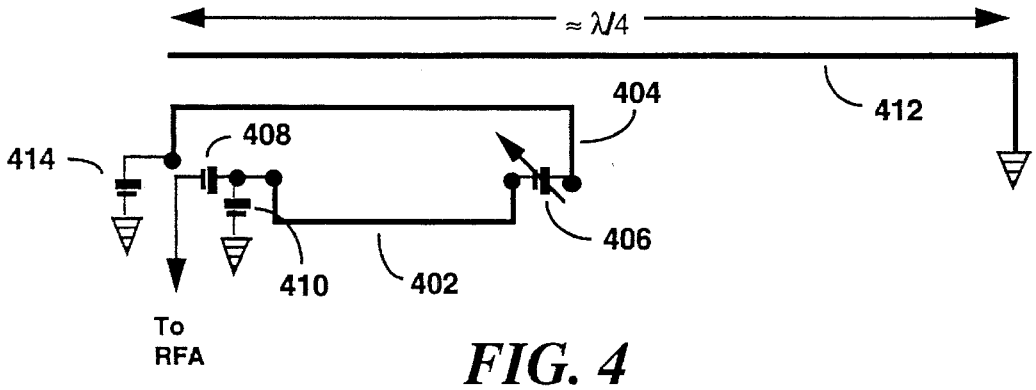
FIG. 4 is an electrical diagram of the antenna of the card-like communication receiver in accordance with the first embodiment of the present invention.

FIG. 4 is an electrical diagram of the antenna of the card-like communication receiver in accordance with the first embodiment of the present invention. The loop antenna comprises a first portion 402 formed from the isolated portion 110 of the front plate 108, and a second portion 404 formed by the conductor 208. A variable capacitor 406 is used to resonate the loop antenna at the receiver operating frequency. Capacitors 408 and 410 are used to match the antenna impedance to the input impedance of the RF amplifier in a manner well known in the art. Capacitor 414 which then couples to the circuit ground. Capacitor 414 is selected to partially resonate the combination of the E-field and loop antennas at the receiver operating frequency. The back plate 210 forms a monopole E-field antenna 412 which is approximately one-quarter wavelength at the receiver operating frequency, and which electrically couples to the loop antenna. The back plate 210 is approximately 1½ by 3 inches for a card-like communication receiver, and consequently is a quarter of a wavelength at approximately a 930 MHz operating frequency. Thus it will be appreciated the antenna arrangement described above in the preferred embodiment of the present invention would be substantially less efficient at significantly lower operating frequencies, such at low UHF and VHF frequencies unless the size of the back plate forming the E-field antenna is significantly enlarged or the loop antenna is designed to compensate for the difference between the electrical length and physical length of the E-field antenna. One side of the E-field antenna 412 is coupled to the circuit ground.

Figure 5:
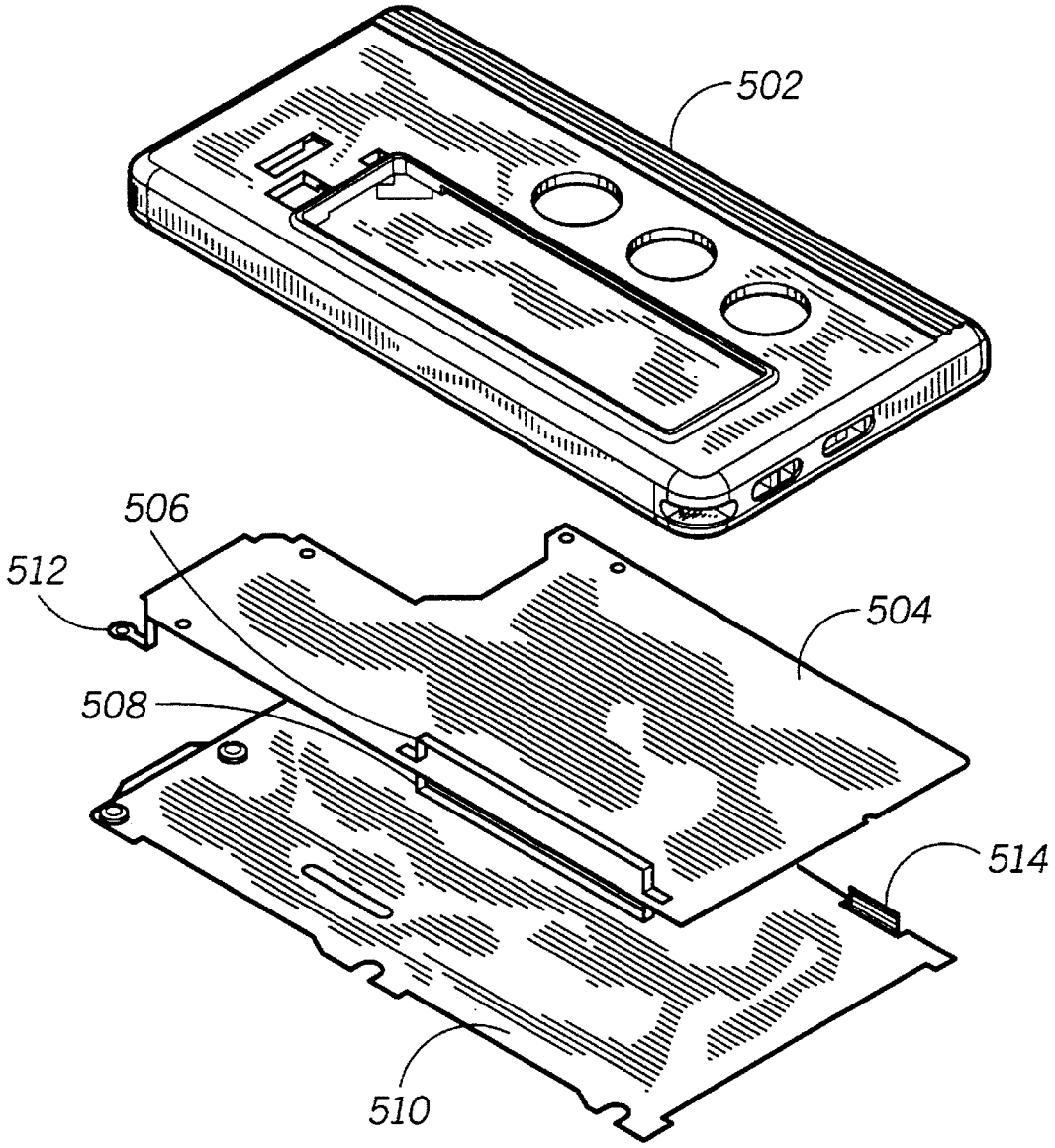
FIG. 5 is an exploded isometric view of the card-like communication receiver in accordance with a second embodiment of the present invention.

FIG. 5 is an exploded isometric view of the card-like communication receiver in accordance with a second embodiment of the present invention. The frame 502 encloses a printed circuit board 504, manufactured using a glass epoxy or other suitable board material, and supports the components forming the receiver and other associated receiver functions. Screws (not shown) are used to secure the printed circuit board 504 to the frame 502 Two conductors 506 and 508, formed preferably from sheet metal, such as hard copper or beryllium copper which is suitably plated to enable RF conductivity and soldering, such as with a silver, gold or tin plating, are attached to the printed circuit board 504 such as by reflow soldering, and forms first and second portions of a loop antenna for the receiver. The back plate 510 is secured to the frame 502 by fingers 514 contiguously formed from the back plate 510 which interlock into the frame 502 and is further secured with screws (not shown). The back plate 510 is electrically coupled to a ground formed on the printed circuit board 504 through a sheet metal conductor 512 which is attached to the printed circuit board 504, such as by reflow soldering, and is secured between the frame 502 and the back plate 510 with the use of a screw (not shown). Unlike the loop antenna described in the first embodiment of the present invention, the loop antenna described above for the second embodiment of the present invention does not require insert molding of the top plate and isolated portion thereof into the front surface of the frame, thereby reducing the complexity of the molding operation.

Figure 6:
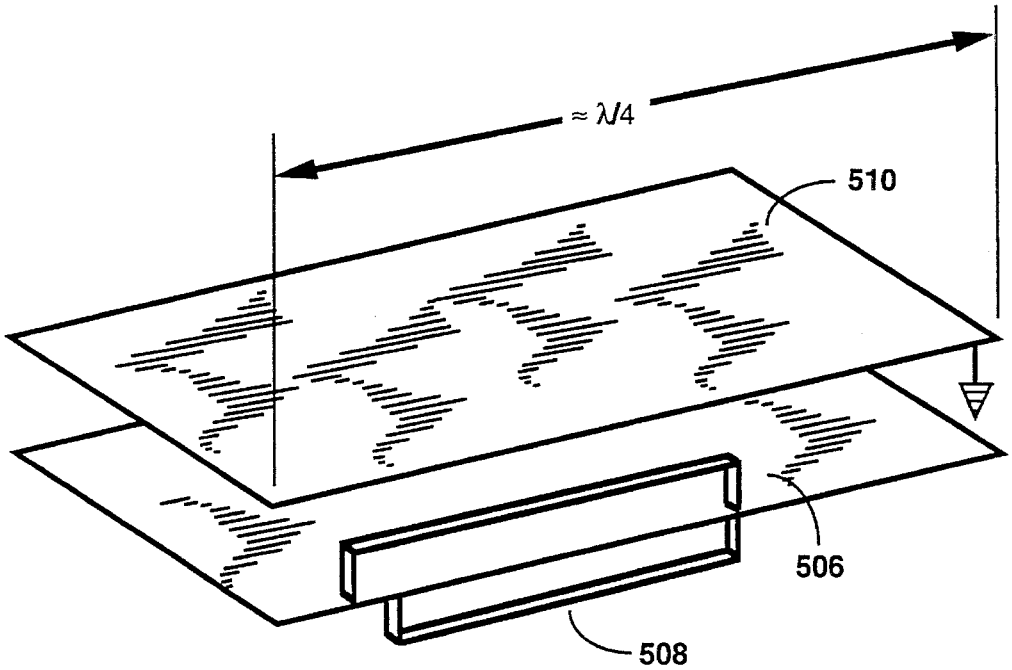
FIG. 6 is an electro/mechanical view of the antenna of the card-like communication receiver in accordance with the second embodiment of the present invention.

FIG. 6 is an electro/mechanical view of the antenna of the card-like communication receiver in accordance with the second embodiment of the present invention. As shown, the loop antenna formed from conductors 506 and 508, when attached to the printed circuit board 504 form first and second portion of the loop antenna. The back plate 510, when attached to the frame 502, is in close proximity to the first conductor 506 forming the upper part of the loop antenna, and operationally electrically couples to the loop antenna, enhancing the operation of the loop antenna when the card-like communication receiver is removed from the body.

Figure 7:
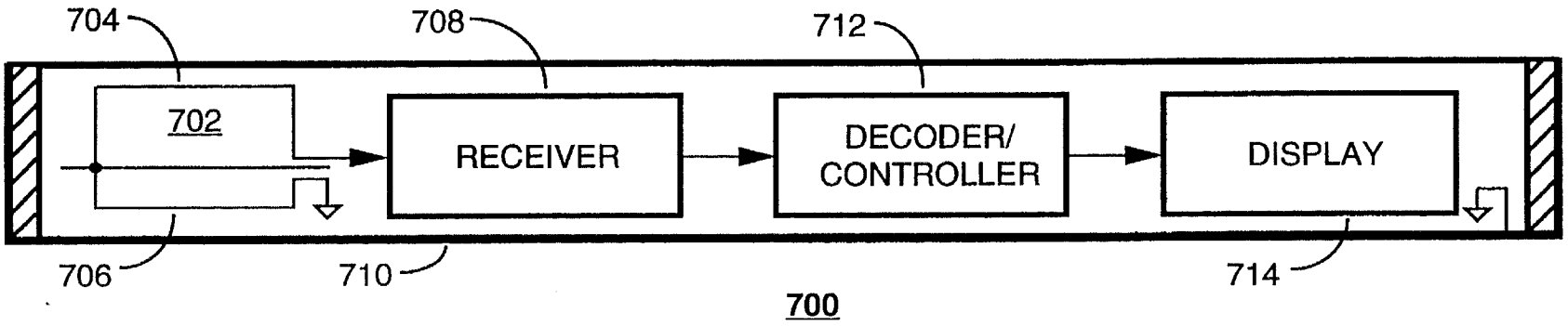
FIG. 7 is an electrical block diagram of the card-like communication receiver in accordance with the present invention.

FIG. 7 is an electrical block diagram of the card-like communication receiver 700 in accordance with the present invention. The loop antenna 702 is formed by two conductor segments 704 and 706, as described in the first and second embodiments of the present invention above, and couples to the input of a receiver 708 which processes received selective call signals in a manner well known in the art. Also electrically coupled to the loop antenna 702 is the back plate 710 of the card-like communication receiver 700, which enhances the antenna operation when the card-like communication receiver is removed from the body. The output of the receiver 708 is a stream of digital or analog information which is processed by a decoder 710 in a manner well known in the art. When a received address matches an address assigned to the card-like communication receiver 700, an alert signal is generated in a manner well known in the art alerting the user of the card-like communication receiver that a message has been received. An audible or vibrate only signal is generated when the card-like communication receiver is a tone only receiver, otherwise either numeric or alphanumeric information can be displayed on a display 712, such as a liquid crystal display, presenting to the user the received message information. A memory (not shown) can be provided to store the received messages for further recall, and a code memory, or code plug (not shown) is used to store assigned address information and operating characteristics of the receiver.

What has been described above is an antenna system for a card-like communication receiver which utilizes a loop antenna formed using in part at least a portion of a front plate which provides stiffness to a molded frame, or a loop antenna attached to a printed circuit board. The back plate which completes the enclosure of a receiver mounted on a printed circuit board located within the frame, functions as an E-field antenna when the card-like communication receiver is removed from the body, thereby enhancing the operation of the card-like communication device for on-the-body and off-the-body receiver operation.

We claim:

1. A low profile antenna system comprising:

a frame, having i front surface and four contiguous side surfaces, for supporting and partially enclosing a printed circuit board having first and second surfaces, said first surface supporting components of a receiver thereon, said front surface of said frame including therewith a first conductive plate and an isolated portion thereof positioned apart from and substantially parallel to said first surface of said printed circuit board, said isolated portion coupling to said first surface of said printed circuit board and forming a first portion of a loop antenna therewith;

a conductor, positioned apart from and substantially parallel to said second surface of said printed circuit board, and coupled thereto and forming a second portion of said loop antenna; and a second conductive plate, positioned adjacent and substantially parallel to said conductor, and mechanically coupled to said frame for forming a rear surface therefor, said second conductive plate being capacitively coupled to said conductor and providing therefrom a means for enhancing the sensitivity of said loop antenna.

2. The low profile antenna system according to claim 1 wherein said second conductive plate is rectangular, having a length substantially greater than the width of said second conductive plate.

3. The low profile antenna system according to claim 2 wherein said receiver receives a signal at a predetermined operating frequency, and wherein said length of said second conductive plate is substantially a quarter wavelength at the predetermined operating frequency.

4. The low profile antenna system according to claim 1, wherein said loop antenna couples between an input of said receiver and a circuit ground.

5. The low profile antenna system according to claim 4, wherein said second conductive plate couples to said circuit ground.

6. The low profile antenna system according to claim 1 wherein said frame is molded from a thermoplastic, and wherein said first conductive plate is insert injection molded into said frame.

7. The low profile antenna system according to claim 1 wherein said second conductive plate functions as an E-field monopole antenna coupled to said loop antenna.

8. The low profile antenna system according to claim 1 wherein said first and second conductive plates are formed from sheet metal, and wherein said isolated portion of said first conductive plate is mechanically separated from said first conductive plate.

9. The low profile antenna system according to claim 1 wherein said isolated portion of said first conductive plate is coupled to said printed circuit board using fasteners.

10. A communication receiver comprising:

a frame having front and side surfaces for enclosing a printed circuit board supporting a receiver;

a first conductive plate, and an isolated portion thereof which couples to said printed circuit board and forms a first portion of a loop antenna;

a conductor, coupled to said printed circuit board for forming a second portion of the loop antenna;

a conductive plate, coupled to said frame and forming a rear surface therefor, said conductive plate being electrically coupled to said loop antenna and providing therefrom a means for enhancing the sensitivity of said loop antenna;

said receiver being coupled to said loop antenna and said conductive plate to enable receiving a transmitted selective call message including address and message information;

a decoder, coupled to said receiver, for enabling a reception of the transmitted message information in response to a reception of the transmitted address; and means for displaying the received message information.

11. The low profile antenna system according to claim 10 wherein said loop antenna is formed from at least first and second conductors mechanically and electrically coupled to said printed circuit board.

12. The low profile antenna system according to claim 11 wherein said receiver receives a signal at a predetermined operating frequency, and wherein said length of said conductive plate is substantially a quarter wavelength at the predetermined operating frequency.

13. The low profile antenna system according to claim 10 wherein said conductive plate is rectangular, having a length substantially greater than the width of said conductive plate.

14. The low profile antenna system according to claim 13, wherein said conductive plate couples to said circuit ground.

15. The low profile antenna system according to claim 10, wherein said loop antenna couples between an input of said receiver and a circuit ground.

* * * * *

UNITED STATES PATENT AND TRADEMARK OFFICE

CERTIFICATE OF CORRECTION

PATENT NO. : 5,469,178

DATED : November 21, 1995

INVENTOR(S) : Nguyen, et al.

It is certified that error appears in the above-indentified patent and that said Letters Patent is hereby corrected as shown below:

Claim 1, Column 5, Line 36, change "i" to --a--.

Signed and Sealed this

Twenty-eighth Day of May, 1996

*Attest:*

Bruce Lehman

BRUCE LEHMAN

*Attesting Officer*

*Commissioner of Patents and Trademarks*